US005732426A

United States Patent [19]

Furuya et al.

[11] Patent Number: 5,732,426

[45] Date of Patent: Mar. 31, 1998

[54] PILLOW FILLED WITH CHIPS OF CYPRESS

[76] Inventors: Mitsumasa Furuya, 8-18, Haruecho, 2-chome, Edogawa-ku, Tokyo, Japan, 132; Chin Mei Hung, 5th Fl, No.24, Lane 30, Hsin Shang St., Chun-Ho City Taipei Hsien, Taiwan

[21] Appl. No.: 803,644

[22] Filed: Feb. 21, 1997

[30] Foreign Application Priority Data

Feb. 21, 1996 [JP] Japan ..... 8-001741 U

[51] Int. Cl.[6] ..... A47G 9/00

[52] U.S. Cl. ..... 5/636; 5/641; 5/951

[58] Field of Search ..... 5/636, 637, 639, 5/640, 641, 643, 644, 652, 702, 697, 951; D6/601

[56] References Cited

U.S. PATENT DOCUMENTS

| | | | |
|---|---|---|---|
| 1,890,358 | 12/1932 | Barcalo | 5/640 |
| 3,234,569 | 2/1966 | Stewart | 5/636 |
| 3,899,797 | 8/1975 | Gunst | 5/633 |
| 4,754,511 | 7/1988 | Sargent | 5/644 |
| 4,959,880 | 10/1990 | Tesch | 5/640 |
| 5,363,524 | 11/1994 | Lang | 5/640 |
| 5,475,882 | 12/1995 | Sereboff | 3/644 |
| 5,522,105 | 6/1996 | Fujiwara et al. | 5/645 |

FOREIGN PATENT DOCUMENTS

| | | | |
|---|---|---|---|
| 3-4750 | 1/1991 | Japan . | |
| 405161532 A | 6/1993 | Japan | 5/636 |
| 6-45565 | 6/1994 | Japan | 5/636 |
| 2184009 | 6/1987 | United Kingdom | 5/951 |

*Primary Examiner*—Alexander Grosz

*Attorney, Agent, or Firm*—Jacobson, Price, Holman & Stern, PLLC

[57] ABSTRACT

A pillow has a rope which is disposed within the pillow so as to connect the central portions of both end surfaces of the pillow. When a user places his or her head on the pillow, part of a load from the head is borne by the rope via the filling material. Further, although the filling material tends to move to the left and right due to the weight of the head and causes the end surfaces of the pillows to bulge leftward and rightward, respectively, such movement of the filling material is restricted by the rope. The filling material includes chips of cypress that have been subjected to steam heat treatment. Therefore, the filling material produces a scent that provides the user with a feeling that he or she is in a forest. Moreover, since the length of the rope can be adjusted from the outside, the height of the pillow can be adjusted.

2 Claims, 2 Drawing Sheets

PILLOW FILLED WITH CHIPS OF CYPRESS

BACKGROUND OF THE INVENTION

1. Field of the Invention

The present invention relates to a pillow used for sleeping.

2. Discussion of Related Art

Conventional pillows are formed in a manner such that a cloth bag is filled with rice hulls, buckwheat hulls, or a like material, and the opposite longitudinal ends of the bag are then closed.

Due to the above-described structure, when a user places his or her head 1 on a pillow 2 as shown in FIG. 5, a portion 3 of the pillow 2 under the head 1 is depressed due to the weight of the head 1. As a result, the density of a filling material 4 is increased at that portion, and the filling material 4 in the pillow 2 moves to the left and right in FIG. 5, so that the left and right end portions 5 bulge.

When the filling material 4 under the head 1 moves to the left and right due to a pressing force from the head 1, the height of the pillow decreases, and air permeability deteriorates due to the increased density of the filling material 4. Since deterioration in air permeability adversely affects radiating the heat of the head 1, such deterioration of air permeability is detrimental.

SUMMARY OF THE INVENTION

An object of the present invention is to provide an improved pillow in which even upon supporting a head, the portion under the head is not depressed much by the weight of the head, thereby preventing longitudinal movement of a filling material within the pillow.

Another object of the present invention is to provide a pillow which uses a special filling material so as to provide the user with a feeling that he or she is in a forest.

Still another object of the present invention is to provide a pillow which allows a user to adjust the height of the pillow.

In order to achieve the above objects, the present invention provides a pillow that is formed by filling a tubular cloth bag with a filling material and by subsequently closing the longitudinal opposite ends of the cloth bag, wherein a rope is disposed within the cloth bag so as to connect the central portion of both end surfaces of the cloth bag.

In the pillow of the present invention, part of a load from the head is borne by the rope via the filing material. Further, although the filling material tends to move to the left and right due to the weight of the head and causes the end surfaces of the pillows to bulge leftward and rightward, respectively, such movement of the filling material is restricted by the rope, which is provided at the center portion of the pillow so as to connect the opposite end surfaces of the cloth bag. As a result, the extent of depression of the pillow caused by the weight of the head is small, and the density of the filling material does not change very much. In addition, the pillow has excellent air permeability and heat radiating performance.

Preferably, the filling material comprises chips of cypress that have been subjected to steam heat treatment. In this specification, the term ■cypress■ means *Chamaecyparis abtusa* or the like.

In this case, the filling material produces a scent that provides the user with a feeling that he or she is in a forest, thereby helping the user to sleep well.

Preferably, the length of the rope which connects the central portions of both end surfaces of the pillow can be adjusted from the outside.

In this case, the height of the pillow can be changed through adjustment of the length of the rope. That is, the height of the pillow can be increased by decreasing the length of the rope.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DETAILED DESCRIPTION OF THE PREFERRED EMBODIMENTS

An embodiment of the present invention will now be described with reference to the drawings.

Figure 1:
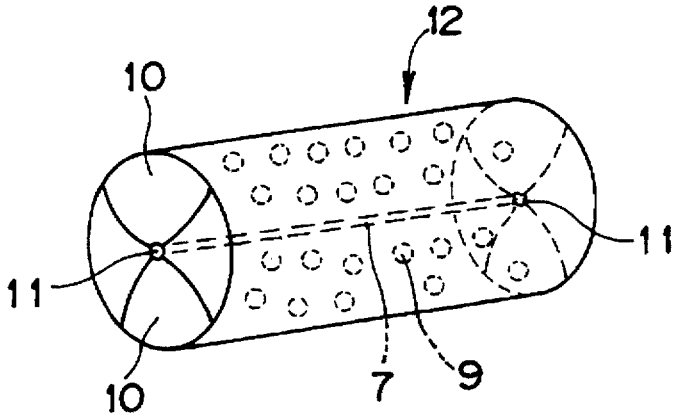
FIG. 1 is a perspective view of a pillow according to the present invention.
Figure 2A:
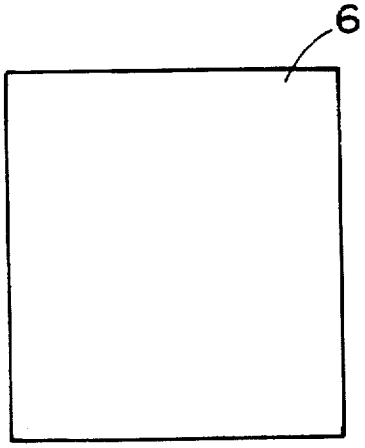
FIGS. 2A–2D are explanatory views shown an example of a method for manufacturing the pillow according to the present invention.
Figure 2B:
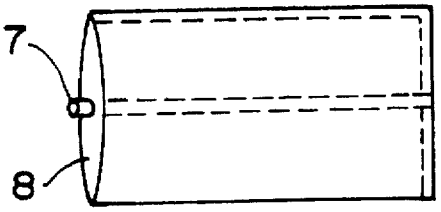
Figure 2C:
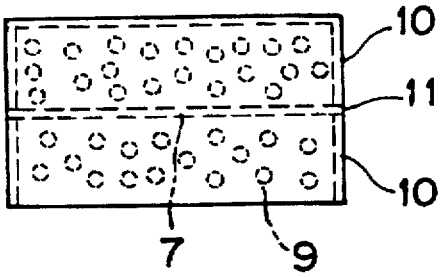
Figure 2D:
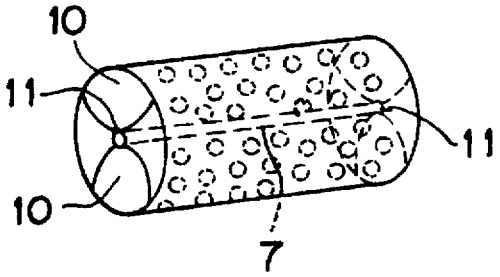

FIG. 1 is a perspective view of a pillow according to the present invention. This pillow can be manufactured by, for example, a method shown in FIGS. 2A–2D. A piece of cloth 6 shown in FIG. 2A is folded in two at the centers of the two shorter sides. As shown in FIG. 2B, two sides of the folded cloth 6 are sewn such that a rope 7 having a length slightly larger than the lateral length of the folded cloth is held between the halves of the folded cloth 6. A filling material 9 is charged into the bag through an opening 8 that has not been sewn. Subsequently, the front end portion of the rope 7 disposed in the bag is pulled and positioned at the center of the side of the cloth 6, which side forms the opening 8, and that side is sewn together with the tip end of the rope 7 while the position of the rope 7 is maintained, so that the opening 8 is closed as shown in FIG. 2C. Subsequently, both end portions 10 of the sewn portion at either end of the folded cloth 6 are folded toward the central portion 11 of a corresponding side such that each of the end portions 10 forms a triangular shape, and the opposite end portions 10 are sewn to the central portion 11. Thus, there is produced a cylindrical pillow 12 in which the rope 7 is disposed so as to connect the centers of the two end surfaces.

A variety of methods other than the above-described method may be used so as to fill the cylindrical cloth bag with the filling material 9 and to connect the central portions of both sealed end portions of the cylindrical bag through use of the rope 7. In essence, when one end of a cylindrical cloth bag is closed, one end of the rope 7 is connected to the center of the closed end. Subsequently, the cylindrical cloth bag is stuffed with the filling material 9 that is supplied into the interior of the cloth bag through the open portion of the cloth bag while the rope is being pulled. The open portion of the cloth bag is then sewn in a state in which the other end of the rope 7 is pulled out of the bag through the center of the open portion. Finally, the other end of the rope 7 is sewn to the center of the sewn area of the open portion such that the rope 7 has a predetermined length within the cloth bag. Alternatively, a knot is made at the other end of the rope 7 so as to prevent the rope 7 from being withdrawn into the interior of the cloth bag. The length of the rope 7 is made substantially the same as that of the pillow 12.

Figure 3:
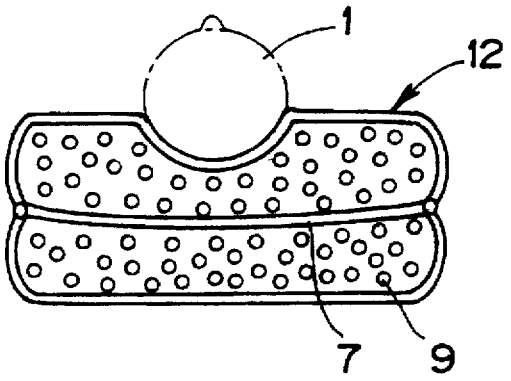
FIG. 3 is a cross section showing a state in which a user has placed his/her head on the pillow according to the present invention.

FIG. 3 shows a state in which a user has placed his/her head 1 on the pillow 12. Due to the placement of the head 1, a load acts on the filling material 9 in the pillow 12, so that the upper surface of the pillow 12 is depressed. However, since the rope 7, which provides connection between both longitudinal ends of the pillow 12, is disposed at the center of the pillow 12, part of the load from the head 1 is borne by the rope 7 via the filling material 9. Further, although the filling material 9 tends to move to the left and right due to the weight of the head 1 and cause both end surfaces of the pillow to bulge leftward and rightward, respectively, such movement of the filling material 9 is restricted by the rope 7, which is provided at the center portion of the pillow 12 so as to connect the opposite end surfaces of the pillow 12. As a result, the extent of depression of the pillow 12 caused by the weight of the head 1 is small, and the density of the filling material 9 does not change very much. In addition, the pillow 12 has excellent air permeability and heat radiating performance.

Figure 4:
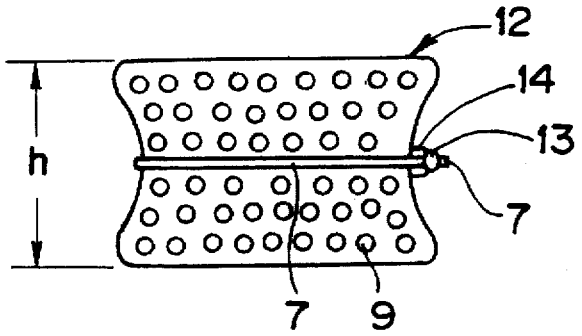
FIG. 4 is a cross section shown a state in which the height of the pillow according to the present invention has been increased by shortening the length of the rope provided in the pillow.
Figure 5:
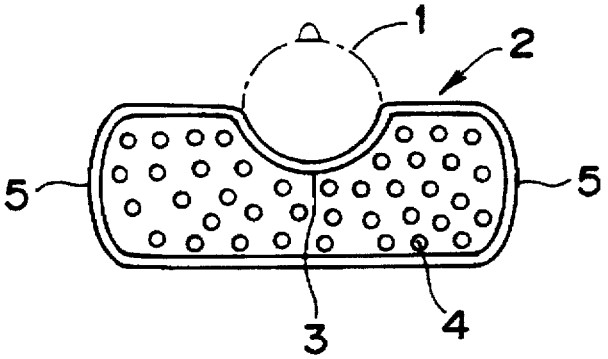
FIG. 5 (PRIOR ART)
FIG. 5 is a cross section shown a conventional pillow in use.

When the length of the rope 7 is adjustable, the height of the pillow can be changed, as shown in FIG. 4. That is, when the length of the rope 7 is decreased, the height h of the pillow is increased.

A simple method for adjusting the length of the rope 7 within the pillow 12 is to make a knot and change the position of the knot. That is, the pillow 12 is made such that the tip end of the rope 7 extends outwardly from one end surface of the pillow 12. Subsequently, a knot 13 is formed at a position such that the length of the rope 7 within the pillow 12 becomes a desired length and such that the tip end of the rope 7 is prevented from being pulled into the interior of the pillow 12. Preferably, a button or wood block 14 having a hole through which the rope 7 passes is provided between the end surface of the pillow 12 and the knot 13. This prevents the knot 13 from being withdrawn into the cloth of the pillow 12. In the pillow 12, there is a possibility that the filling material 9 will leak from the pillow 12 through a hole of the pillow 12 through which the rope 7 is passed. In order to solve this problem, such a hole is preferably sealed through use of nonwoven cloth or rubber material.

The filling material 9 is preferably made of chips of cypress that have been subjected to steam heat treatment. In this case, the filling material 9 produces a scent that provides the user with a feeling that he or she is in a forest, thereby helping the user to sleep well.

Chips of untreated cypress may be used as a filing material. However, when the steam-heat-treated cypress chips (chips obtained from cypress that has been subjected to steaming with water steam so as to remove oily components to some degree) are used, emission of residual essential oil occurs more easily, as compared with the case where raw wood is used. Therefore, when the pillow 12 is used, emission of hinokitiol (β-Thujaplicin), which is a main component of cypress essential oil, occurs easily even at room temperature. It is known that hinokitiol has antimicrobial activity and a tranquilizing effect.

Since essential oil is removed from wood cells of cypress during steam treatment, the cypress chips have a porous structure (i.e., have many fine pores), so that they provide an effect of absorbing smells, similar to the absorbing effect of active carbon.

Cypress chips break into powders when they are used for a prolonged period of time, and such powders may leak, from the pillow through spaces in the cloth or through a seam. Therefore, the cloth used for the pillow preferably has a layered structure in which a foamed resin or chemical fiber cotton is sandwiched between raw material cloth.

The use of such cloth not only prevents leakage of the powders but also provides effects similar to those provided by a cotton filter used for a sterile operation in the field of bacteriology. That is, the layered cloth can prevent outside bacteria from contaminating the filling material (cypress chips) of the pillow, while maintaining air permeability. In addition, the antimicrobial activity of the cypress chips always guarantees sanitary use.

Obviously, numerous modifications and variations of the present invention are possible in light of the above teachings. It is therefore to be understood that within the scope of the appended claims, the present invention may be practiced in other ways than as specifically described herein.

What is claimed is:

1. A pillow comprising:

a tubular cloth bag having layers of one of foamed resin and fiber cotton sandwiched between raw material cloth for preventing leakage of powders and for filtering bacteria from contaminating filling material;

a filling material charged into said cloth bag, said filling material including steam heat treated chips of cypress for emission of hinokitiol at room temperature, the longitudinal opposite ends of said cloth bag being closed after said cloth bag being filled with said filling material; and a rope which is disposed within said cloth bag so as to connect the central portions of both end surfaces of said cloth bag.

2. pillow according to claim 1, wherein the length of said rope which connects the central portions of both end surfaces of said cloth bag can be adjusted from the outside.

* * * * *